US010062489B2

(12) United States Patent
Chen et al.

(10) Patent No.: US 10,062,489 B2
(45) **Date of Patent: *Aug. 28, 2018**

(54) RARE EARTH PERMANENT MAGNET AND METHOD FOR PREPARING SAME

(71) Applicant: BEIJING ZHONG KE SAN HUAN HI-TECH CO., LTD., Beijing (CN)

(72) Inventors: Zhi'an Chen, Beijing (CN); E. Niu, Beijing (CN); Wei Zhu, Beijing (CN); Fenghua Chen, Beijing (CN); Yeqing He, Beijing (CN); Xiaolei Rao, Beijing (CN); Boping Hu, Beijing (CN); Haojie Wang, Beijing (CN)

(73) Assignee: BEIJING ZHONG KE SAN HUAN HI-TECH CO., LTD., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/592,964

(22) Filed: May 11, 2017

(65) Prior Publication Data

US 2017/0250019 A1 Aug. 31, 2017

Related U.S. Application Data

(62) Division of application No. 15/519,410, filed as application No. PCT/CN2016/090622 on Jul. 20, 2016.

(30) Foreign Application Priority Data

Aug. 13, 2015 (CN) ..... 2015 1 0498280

(51) Int. Cl.

| | |
|---|---|
| ***H01F 1/00*** | (2006.01) |
| ***H01F 7/02*** | (2006.01) |
| ***H01F 1/057*** | (2006.01) |

(52) U.S. Cl.
CPC ..... *H01F 7/02* (2013.01); *H01F 1/0577* (2013.01)

(58) Field of Classification Search
None
See application file for complete search history.

(56) References Cited

U.S. PATENT DOCUMENTS 8,206,516 B2 * 6/2012 Yoshimura ..... B22F 7/062 148/101
9,242,296 B2 * 1/2016 Kaneko ..... B22F 1/0088
(Continued)

FOREIGN PATENT DOCUMENTS

CN 1898757 1/2007
CN 101331566 12/2008
(Continued)

OTHER PUBLICATIONS

International Search Report dated Oct. 17, 2016 in PCT Application Serial No. PCT/CN2016/090622, 5 pages.

*Primary Examiner* — Kevin M Bernatz
(74) *Attorney, Agent, or Firm* — Hamre, Schumann, Mueller & Larson, P.C.

(57) ABSTRACT

The present invention discloses a rare earth permanent magnet and a method for preparing same. The material of the rare earth permanent magnet has a heavy rare earth element volume diffusion phenomenon at a depth of 5 μm to 100 μm from the surface of the magnet to the interior of the magnet along the magnetic field orientation direction, thereby forming a volume diffusion layer region; the volume diffusion layer region is divided into magnet units having a volume of 10*100*5 μm, and the concentration difference of the heavy rare earth elements of the magnet units at different positions in the volume diffusion layer is below 0.5 at %. The present invention provides a sintered NdFeB magnet of high intrinsic coercive force Hcj on the premise of not influencing the remanence Br and the maximum magnetic energy product (BH)max of products. In the method for preparing the rare
(Continued)

earth permanent magnet, microwave heat treatment is performed on a blank magnet coated with heavy rare earth source slurry in a vacuum condition. This method can effectively improve the heating efficiency, reduce the heat treatment time, lower the energy consumption, and reduce the production cost of the magnet.

4 Claims, 4 Drawing Sheets

(56) References Cited

U.S. PATENT DOCUMENTS

| | | | | |
|---|---|---|---|---|
| 9,350,203 | B2 * | 5/2016 | Baba | C22C 38/005 |
| 2006/0278517 | A1 * | 12/2006 | Machida | C23C 14/3464 204/192.1 |
| 2007/0034299 | A1 * | 2/2007 | Machida | H01F 1/0575 148/105 |
| 2008/0241513 | A1 * | 10/2008 | Komuro | H01F 1/0577 428/328 |
| 2009/0020193 | A1 * | 1/2009 | Ohta | H01F 1/0577 148/559 |
| 2012/0229240 | A1 | 9/2012 | Yoshimura et al. | |
| 2017/0221615 | A1 * | 8/2017 | Chen | H01C 7/112 |
| 2017/0250019 | A1 * | 8/2017 | Chen | H01F 7/02 |

FOREIGN PATENT DOCUMENTS

| | | |
|---|---|---|
| CN | 102274974 | 12/2011 |
| JP | 2011211041 | 10/2011 |
| JP | 201417480 | 1/2014 |
| JP | 2015144220 | 8/2015 |

* cited by examiner

| Region1 | wt% | at% |
|---|---|---|
| Co K | 29.29 | 49.32 |
| Pr L | 18.57 | 12.58 |
| Nd L | 24.00 | 17.80 |
| Tb L | 30.15 | 20.30 |

| Region2 | wt% | at% |
|---|---|---|
| Al K | 0.37 | 0.97 |
| Fe K | 64.24 | 80.89 |
| Co K | 0.47 | 0.57 |
| Cu K | 2.11 | 2.33 |
| Pr L | 5.13 | 2.56 |
| Nd L | 9.59 | 4.68 |
| Tb L | 18.09 | 8.06 |

| Region3 | wt% | at% |
|---|---|---|
| Al K | 0.39 | 1.02 |
| Fe K | 64.05 | 80.60 |
| Co K | 0.61 | 0.75 |
| Cu K | 2.14 | 2.37 |
| Pr L | 5.59 | 2.79 |
| Nd L | 10.17 | 4.95 |
| Tb L | 17.05 | 7.54 |

| Region4 | wt% | at% |
|---|---|---|
| Al K | 0.37 | 0.94 |
| Fe K | 67.05 | 82.72 |
| Co K | 0.54 | 0.63 |
| Cu K | 1.10 | 1.19 |
| Pr L | 9.03 | 4.40 |
| Nd L | 16.63 | 7.92 |
| Tb L | 5.08 | 2.19 |

| Region5 | wt% | at% |
|---|---|---|
| Fe K | 67.01 | 83.46 |
| Cu K | 0.90 | 0.98 |
| Pr L | 11.11 | 5.48 |
| Nd L | 19.96 | 9.62 |
| Tb L | 1.02 | 0.45 |

| Region6 | wt% | at% |
|---|---|---|
| Al K | 0.35 | 0.89 |
| Fe K | 67.65 | 88.30 |
| Cu K | 0.70 | 0.76 |
| Pr L | 11.27 | 5.50 |
| Nd L | 20.04 | 9.56 |

| Region1 | wt% | at% |
|---|---|---|
| Al K | 0.42 | 1.10 |
| Fe K | 64.90 | 81.67 |
| Cu K | 1.61 | 1.78 |
| Pr L | 5.79 | 2.89 |
| Nd L | 11.22 | 5.47 |
| Tb L | 16.06 | 7.10 |

| Region2 | wt% | at% |
|---|---|---|
| Fe K | 66.37 | 83.00 |
| Cu K | 1.33 | 1.47 |
| Pr L | 9.75 | 4.83 |
| Nd L | 17.76 | 8.60 |
| Tb L | 4.78 | 2.10 |

| Region3 | wt% | at% |
|---|---|---|
| Al K | 0.41 | 1.03 |
| Fe K | 67.55 | 82.62 |
| Co K | 0.69 | 0.80 |
| Cu K | 0.85 | 0.91 |
| Pr L | 10.88 | 5.28 |
| Nd L | 19.62 | 9.30 |

RARE EARTH PERMANENT MAGNET AND METHOD FOR PREPARING SAME

TECHNICAL FIELD

The present invention relates to the field of rare earth permanent magnet preparation technologies, and more particularly to a method for preparing a rare earth permanent magnet which can improve the intrinsic coercive force of the magnet on the premise of substantially not reducing the remanence, and a rare earth permanent magnet prepared by using this method.

BACKGROUND ART

Currently, the laboratory level of the maximum magnetic energy product of sintered NdFeB is very close to its theoretical limit value. Although the difference between the production level and the limit value is not large, the intrinsic coercive force of the sintered NdFeB is much lower than the theoretical limit value and can be largely improved. With continuous development of the application field of the NdFeB magnet, persons in the art are seeking to obtain higher coercive force. Therefore, the problem that how to make a full play of the inherent properties of the main phase of NdFeB and then improve the intrinsic coercive force $H_{cj}$ of the sintered NdFeB becomes a hot issue to be studied at present.

Years of fundamental researches and production practices suggest that, it is a well-known effective method to add heavy rare earth elements, such as Dy (element dysprosium) and Tb (terbium), etc., in the production process of a magnet to substitute a part of Nd in the magnet, thereby improving the coercive force of the sintered NdFeB magnet.

The main reason is that $Dy_2Fe_{14}B$ or $Tb_2Fe_{14}B$ crystal has a higher magnetocrystalline anisotropy field than $Nd_2Fe_{14}B$ crystal, that is, has higher theoretical intrinsic coercive force.

After a part of Nd in the main phase $Nd_2Fe_{14}B$ is substituted by Dy and Tb, the magnetocrystalline anisotropy field of the generated solid-solution phase $(Nd,Dy)_2Fe_{14}B$ or $(Nd,Tb)_2Fe_{14}B$ is higher than that of $Nd_2Fe_{14}B$, thereby significantly improving the coercive force of the sintered magnet.

The methods for adding Dy and Tb generally include: a method of directly adding Dy and Tb in an alloy smelting process; or a dual-alloy method of a Dy/Tb-rich alloy and an NdFeB alloy. However, the defect of the two methods, especially the direct smelting method, is that the saturation magnetization of the magnet may significantly be reduced, thereby reducing the remanence and the maximum magnetic energy product of the magnet. The reason is that in the main phase Nd2Fe14B, the magnetic moments of Nd and Fe are arranged in parallel in the positive direction, and are superposed in the same direction; Dy/Tb and Fe are anti-ferromagnetically coupled, and the magnetic moment of Dy/Tb and that of Fe are superposed in opposite directions, thereby resulting in a reduction of the total magnetic moment.

Besides, as compared with Nd, the Dy and Tb-containing mineral reserves are rare and are mainly distributed in a few regions, and the prices of the metal Dy and Tb are much higher than that of the metal Nd, which results in a significant increase in the production cost of the magnet.

In recent years, the grain boundary heat diffusion process is used for effectively improving the intrinsic coercive force of the sintered NdFeB magnet, with rarely reducing the remanence and the magnetic energy product of the magnet. In this process, a substance layer containing heavy rare earth elements, such as metal powder of Dy or Tb or a compound containing Dy or Tb, is covered on the magnet by using methods such as coating, depositing, plating, sputtering, and adhering, and through heat treatment, the heavy rare earth elements are caused to diffuse into the interior of the magnet along an Nd-rich liquid grain boundary phase. In the heat treatment process, the diffusion speed of Dy/Tb in the grain boundary is much higher than that of Dy/Tb in the grain boundary diffusing into the interior of the main phase grains.

A thin and continuous shell layer containing heavy rare earth elements will be generated between the main phase of the sintered body and the rare earth-rich phase by adjusting the heat treatment temperature and time on the basis of the diffusion speed difference.

Because the coercive force of the sintered NdFeB magnet is determined by the anisotropy of main phase particles, the sintered NdFeB magnet with a high-concentration heavy rare earth element shell layer coated has a high coercive force outside main phase grains. The high-concentration regions are limited to the surface layer of each main phase grain, and the volume ratio of the high-concentration regions to the main phase grains is very low, so the remanence (Br) and the maximum magnetic energy product of the magnet basically remain the same.

For example, a diffusion coating technology on the surface of a magnet is disclosed in the patent publication CN1898757A applied by Shin-Etsu Chemical Co., Ltd. A sintered blank is processed into a thin magnet which is then dip-coated with the slurry formed by dispersing heavy rare earth micron-sized fine powder into water or an organic solvent, and a heat treatment is performed on the magnet in vacuum or in an inert gas atmosphere and at a temperature which is not higher than the sintering temperature. As a result, the coercive force is largely improved, and the remanence is substantially not reduced. This method not only saves the heavy rare earth, but also inhibits the reduction of the remanence.

The above methods can partly improve the $H_{cj}$ and require a grain boundary heat diffusion process that is performed at about 900° C. and lasts for several hours, so that the heavy rare earth elements on the surface of the magnet move toward the interior of the magnet, and a high-content shell layer is formed on the surface of main phase grains of the magnet, and finally the coercive force of the magnet is improved.

However, as a normal heating manner (generally resistance heating) is adopted, the heating mechanism is mainly based on radiation and conduction, and the heating efficiency is low. Meanwhile, as the regions where grain boundary heat diffusion of heavy rare earth metal elements really occurs are merely centralized within a certain range on the surface layer of the magnet, it is a waste of energy to heat a part of the core portion of the magnet that does not participate in the diffusion process, and thus the production cost is increased.

If the heating efficiency can be effectively improved and localized heating can be selectively performed, the process is simplified, the time for heat treatment is reduced, the energy consumption is lowered, and the production cost of a magnet is reduced.

SUMMARY OF THE INVENTION

The first object of the present invention is to provide a rare earth permanent magnet.

The second object of the present invention is to provide a method for preparing the rare earth permanent magnet.

To achieve the first object, the present invention provides a rare earth permanent magnet, wherein the material has a heavy rare earth element volume diffusion phenomenon at a depth of 5 μm to 100 μm from the surface of the magnet to the interior of the magnet along the magnetic field orientation direction, thereby forming a volume diffusion layer region; the volume diffusion layer region is divided into magnet units having a volume of 10*100*5 μm, and the concentration difference of the heavy rare earth elements in the magnet units at different positions in the volume diffusion layer is below 0.5 at %. In the present invention, at % represents atomic percentage.

In the rare earth permanent magnet according to the present invention, preferably, the heavy rare earth elements are Tb and Dy.

In the rare earth permanent magnet according to the present invention, preferably, a grain boundary diffusion region exists between the volume diffusion region of the magnet and the internal magnet; the difference between the heavy rare earth content in the internal magnet and the heavy rare earth content in the magnet before diffusion is not greater than 0.1 at %; at least 70% of the grains by quantity in the grain boundary diffusion region have a shell-core structure, the content of the heavy rare earth elements in the core portion is lower than the content of the heavy rare earth elements in the shell portion, and the difference between the two contents is at least 1 at % and is preferably 1 to 4 at %. The magnet sequentially has the volume diffusion region, the grain boundary diffusion region, and the internal magnet from the exterior to the interior.

To achieve the second object, the present invention provides a method for preparing the rare earth permanent magnet, which includes the following steps:

Step 1: preparing a blank magnet;

Step 2: preparing heavy rare earth source slurry: uniformly mixing any one or more of metal powder of heavy rare earth elements, an alloy containing heavy rare earth elements, a solid solution containing heavy rare earth elements, and a compound containing heavy rare earth elements with an organic solvent to prepare the heavy rare earth source slurry;

Step 3: coating the heavy rare earth source slurry onto at least one surface of the blank magnet to form a coating layer; and Step 4: performing a microwave heat treatment: performing the microwave heat treatment on the coated blank magnet in a vacuum condition, wherein the temperature for the heat treatment is 650° C. to 1000° C., and the heat preservation time is 1 minute to 60 minutes.

The method for preparing the rare earth permanent magnet according to the present invention further includes Step 5 after Step 4, where in Step 5, normal heat treatment is performed on the blank magnet obtained after microwave heat treatment in Step 4, wherein the normal heat treatment temperature is 400° C. to 600° C., and the heat preservation time is 60 minutes to 300 minutes.

In the method for preparing the rare earth permanent magnet according to the present invention, further, the thickness of the blank magnet is not greater than 10 mm in the minimum thickness direction.

In the method for preparing the rare earth permanent magnet according to the present invention, further, the heavy rare earth elements include, but are not limited to, Dy, Tb, and Ho; the metal powder of the heavy rare earth elements at least contains a heavy rare earth element, and the average particle size of the powder is 1 μm to 100 μm.

In the method for preparing the rare earth permanent magnet according to the present invention, further, the compound containing the heavy rare earth elements includes at least one of a rare earth metal hydride, a rare earth metal fluoride, a rare earth metal oxide, and a rare earth metal nitrate hydrate.

In the method for preparing the rare earth permanent magnet according to the present invention, further, the alloy containing the heavy rare earth elements is represented by $R_a$-$M_b$ or $R_xT_yM_z$;

wherein R is selected from at least one of the heavy rare earth elements; M is selected from at least one element of Al, Si, C, P, Ti, V, Cr, Mn, Ni, Cu, Zn, Ga, Ge, Zr, Nb, Mo, Ag, In, Sn, Sb, Hf, Ta, W, Pb, and Bi; and T is selected from at least one of Fe and Co;

wherein a and b; x, y, and z are atomic percentages of the corresponding elements, $15<b\leq 99$, with the balance a; or $5\leq x\leq 85$, $15<z\leq 95$, with the balance y, and y is greater than 0.

In the method for preparing the rare earth permanent magnet according to the present invention, further, the organic solvent is at least one of alcohols, esters, and alkanes.

In the method for preparing the rare earth permanent magnet according to the present invention, further, the thickness of the coating layer is smaller than or equal to 0.5 mm.

The method for preparing the rare earth permanent magnet according to the present invention further includes a step of performing a surface treatment on the blank magnet to clear away an oxide layer thereon before Step 3.

The method for preparing the rare earth permanent magnet according to the present invention further includes a step of drying the coated blank magnet for volatilization to remove the organic solvent in the coating layer after Step 3. Preferably, during the drying for volatilization, the drying temperature is 20° C. to 200° C., and the drying time is at least 1 minute.

In the method for preparing the rare earth permanent magnet according to the present invention, further, after Step 5 is completed, the blank magnet is cooled to below 100° C. in a rapid cooling or a furnace cooling manner, and then surface treatment is performed on the blank magnet to remove the coating layer on the surface of the blank magnet.

The present invention has the following beneficial effects.

By means of the present invention, the intrinsic coercive force Hcj of the sintered NdFeB magnet is improved on the premise of not influencing the remanence Br and the maximum magnetic energy product (BH)max of products, and the heating efficiency can be effectively improved, the heat treatment time is reduced, the energy consumption is lowered, and the production cost of the magnet is reduced.

In the present invention, by combining the microwave heat treatment and grain boundary heat diffusion and by improving grain boundary features as well as the interaction between the grain boundary and the main phase grains, the magnetocrystalline anisotropy field on the surface layer of each main phase grain is improved, and then the intrinsic coercive force Hcj of the sintered NdFeB magnet is improved, and moreover, the influence on the remanence Br and the maximum magnetic energy product (BH)max is small.

During grain boundary heat diffusion in a conventional process, normal heat-source heating is adopted, wherein the main heating mechanism is radiation and conduction, the heating proceeds from the exterior to the interior, and the heating time is long. During grain boundary heat diffusion of the present invention, cold-source heating is adopted as the heating manner, wherein microwave is mainly used to interact with a sample to produce wave-absorbing effects, and by adjusting the microwave transmitting frequency, the skin depth may be matched with the diffusion depth. Thereby, the electromagnetic energy is converted into heat energy to achieve the purpose of heating. This manner belongs to body heating with features of high heating speed and uniform heating. Recent studies show that, the microwave heating technology can be adopted in some chemical reactions to effectively reduce the activation energy of the chemical reactions, thereby reducing the chemical reaction temperature and increasing the chemical reaction speed, which belongs to a heat treatment for activation. Therefore, the diffusion time for the cold-source heating is much less than that for normal heat-source heating.

DETAILED DESCRIPTION

Hereinafter, the embodiments of the present invention will be described in detail with reference to examples. The conventional conditions or the conditions recommended by the manufacturer are followed when specific conditions are not defined; and the used reagents or instruments with no manufacturer indicated are all conventional products commercially available.

In the present invention, by combining the microwave heat treatment and grain boundary heat diffusion technologies and by improving grain boundary features as well as the interaction between the grain boundary and the main phase grains, the magnetocrystalline anisotropy field on the surface layer of each main phase grain is improved, and the intrinsic coercive force of the sintered NdFeB magnet is improved on the premise of nearly not reducing the remanence and the magnetic energy product.

Figure 1:
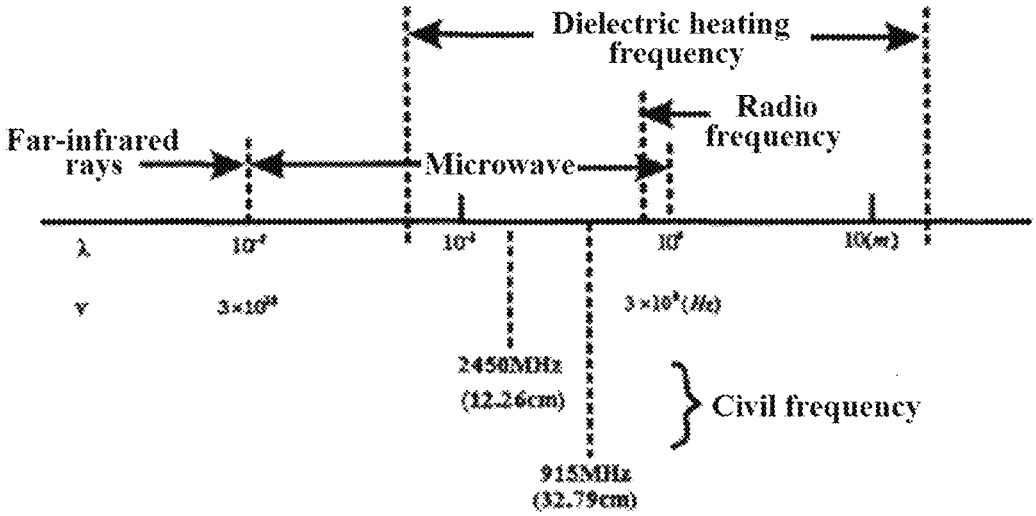
FIG. 1 is a diagram of an electromagnetic wave spectrum.

The microwave is an electromagnetic wave between radio waves and infrared rays, and has the wavelength of 1 mm to 1 m and the frequency of 300 MHz to 300 GHz (the microwave is also called the ultra-high frequency electromagnetic wave because of its high frequency), as shown in FIG. 1. Compared with the electromagnetic wave of other bands, the microwave has features of short wavelength, high frequency, strong penetrating capacity, obvious quantum properties and the like. Compared with the size of general objects on the earth, the wavelength range of the microwave is on the same order of magnitude or smaller. Like other visible lights (except for laser light), the microwave is polarized and a coherent wave, and follows the physical laws of light. The interaction between the microwave and a substance is of selectivity according to different physical properties, that is, the microwave may penetrate through the substance or may be absorbed or reflected by the substance. Moreover, the microwave has the transit-time effect, the radiation effect, and the skin effect.

Due to the skin effect of the microwave on metal, the wave-absorbing depth is not large, and as for grain boundary heat diffusion, diffusion occurs at a certain depth under the surface of a sample (in terms of a macroscopic magnet and a individual grain); therefore, the wave-absorbing depth may be matched with the grain boundary heat diffusion depth by changing the microwave transmitting frequency.

Even if the skin depth is not large, under the conduction effect, the overall temperature of a magnet sample heated by the microwave may raise rapidly, which achieves the purpose of heating, and also largely avoids heating loss in the interior of the magnet (in terms of the macroscopic magnet and the individual grain) where grain boundary heat diffusion does not occur, thereby saving energy and reducing the cost.

As for sintering of non-metallic materials, for example, in the ceramic sintering field, microwave heating has been very widely applied, and these attempts and applications mainly use the activation mechanism and the volume effect of microwave heat treatment as well as high wave-absorbing efficiency of some materials. However, as for a metal block material of near-solid density, because of the wave-absorbing skin effect, a large amount of microwaves are reflected, the effective depth is inadequate, and an obvious temperature gradient exists inside the block. Therefore, microwave heating cannot be directly used in the conventional uniform heat treatment process according to the conventional technical thoughts. However, as for grain boundary heat diffusion (GBD) of the present invention, because permeable elements move from the surface of the sample to the interior of the block, the main reaction occurs on the surface of the block; therefore, the high temperature inside the block may not substantially facilitate the reaction, which provides considerable room for innovation in the present invention to adopt the microwave heat treatment.

The basic process of a method for preparing the rare earth permanent magnet according to the present invention is described in detail below.

Step 1: preparing a blank magnet; wherein the normal process for preparing a blank magnet generally includes: material mixing-alloy smelting-strip formation-powder crushing-shaping-sintering.

Preferably, the thickness of the blank magnet is not greater than 10 mm in the minimum thickness direction.

Step 2: preparing heavy rare earth source slurry: uniformly mixing any one or more of metal powder of heavy rare earth elements, an alloy containing heavy rare earth elements, a solid solution containing heavy rare earth elements, a compound containing heavy rare earth elements, and a rare earth metal nitrate hydrate with an organic solvent to prepare the heavy rare earth source slurry;

The heavy rare earth elements include, but are not limited to, Dy, Tb, and Ho; the metal powder of the heavy rare earth elements at least contains a heavy rare earth element, and the average particle size of the powder is 1 μm to 100 μm.

The compound containing the heavy rare earth elements includes at least one of a rare earth metal hydride, a rare earth metal fluoride, and a rare earth metal oxide.

The alloy containing the heavy rare earth elements is represented by $R_a$-$M_b$ or $R_xT_yM_z$;

wherein R is selected from at least one of the heavy rare earth elements; M is selected from at least one element of Al, Si, C, P, Ti, V, Cr, Mn, Ni, Cu, Zn, Ga, Ge, Zr, Nb, Mo, Ag, In, Sn, Sb, Hf, Ta, W, Pb, and Bi; and T is selected from at least one of Fe and Co;

wherein a and b; x, y, and z are atomic percentages of the corresponding elements, $15<b\leq 99$, with the balance a; or $5\leq x\leq 85$, $15<z\leq 95$, with the balance y, and y is greater than 0.

The organic solvent is at least one of alcohols, esters, and alkanes, such as, ethanol, propanol, ethyl acetate, and n-hexane.

Step 3: performing a surface treatment on the blank magnet to clear away an oxide layer thereon.

Step 4: coating the heavy rare earth source slurry onto at least one surface of the blank magnet to form a coating layer.

Preferably, the thickness of the coating layer is smaller than or equal to 0.5 mm.

Step 5: drying the coated blank magnet for volatilization to remove the organic solvent in the coating layer. Preferably, during the drying for volatilization, the drying temperature is 20° C. to 200° C., and the drying time is at least 1 minute.

Step 6: performing a microwave heat treatment: performing the microwave heat treatment on the coated blank magnet in a vacuum condition, wherein the heat treatment temperature is 650° C. to 1000° C., and the heat preservation time is 1 minute to 60 minutes; after the microwave heat treatment, cooling the blank magnet to below 100° C. in a rapid cooling or furnace cooling manner.

Preferably, in the microwave heat treatment process, the microwave frequency is 2450±50 MHz, and the power is 0 to 10 kW. In the microwave heat treatment process, by adjusting the microwave transmitting frequency, the skin depth is matched with the diffusion depth.

Step 7: performing a normal heat treatment on the blank magnet obtained after the microwave heat treatment, wherein the normal heat treatment temperature is 400° C. to 600° C., and the heat preservation time is 60 minutes to 300 minutes. After the normal heat treatment, the blank magnet is cooled to below 100° C. in a rapid cooling or furnace cooling manner.

Step 8: performing a surface treatment on the blank magnet to remove the coating layer on the surface of the blank magnet.

The above steps may be appropriately adjusted or changed according to specific working environment or requirements.

Example 1

A sintered NdFeB blank magnet is prepared by using a normal process that does not include an aging treatment, wherein the magnet composition (wt. %) is $(PrNd)_{30.5}Al_{0.25}Co_{1.0}Cu_{0.1}Ga_{0.1}Fe_{bal}B_{0.97}$, the magnet size is Φ7 mm×3.3 mm, and the orienting direction is parallel to the axial direction.

5 g of TbCu powder with the average particle size of 5 μm is stirred in 20 ml of absolute ethanol to form the slurry.

The slurry is uniformly coated onto the surface of the magnet in a dip-coating manner, wherein the coating thickness on the upper and lower end surfaces of the magnet is 0.2 mm. The sample is placed in a vacuum environment and normal-temperature dealcoholization is performed for 30 minutes.

A two-stage heat treatment is performed on the magnet coated with the slurry on its surface.

In the first-stage heat treatment, the magnet coated with the slurry on its surface is placed in a vacuum microwave processing furnace for microwave heating, wherein the microwave frequency is 2450 MHz, the heating temperature is set as 920° C., the heat preservation lasts for 3 minutes, and microwave transmission stops after the heat preservation is completed.

The sample is cooled in an air-cooling manner, and the sample is taken out when the temperature thereof is below 100° C.

Then, the second-stage heat treatment is performed, in which the sample after the first-stage heat treatment is placed in a normal vacuum heat-source heating furnace to perform the vacuum heat treatment at 480° C. for 150 minutes; after that, the sample is cooled to below 100° C. in a furnace cooling or air-cooling manner, and then the magnet is taken out.

The residual heavy rare earth source layer is removed from the surface of the magnet in a machining manner, and the magnetic properties of the magnet are measured.

Comparative Example 1-1

The only difference between Comparative Example 1-1 and Example 1 is that the first-stage heat treatment adopts normal heat-source heating, and the heat preservation lasts for 120 minutes.

Comparative Example 1-2

The difference between Comparative Example 1-2 and Comparative Example 1-1 is that no surface coating process is performed before the heat treatment of the magnet.

Comparative Example 1-3

The difference between Comparative Example 1-3 and Example 1 is that no surface coating process is performed before the heat treatment of the magnet.

TABLE 1

Magnetic properties of Example 1 and Comparative Example 1

| | $B_r$ (kGs) | $H_{cj}$ (kOe) | $(BH)_{max}$ (MGOe) | $H_k/H_{cj}$ |
|---|---|---|---|---|
| Example 1 | 13.76 | 18.83 | 46.28 | 0.958 |
| Comparative Example 1-1 | 13.70 | 22.06 | 45.8 | 0.931 |
| Comparative Example 1-2 | 13.72 | 15.23 | 46.18 | 0.977 |
| Comparative Example 1-3 | 13.72 | 15.37 | 46.24 | 0.973 |

Note:
$H_k$ is an external magnetic field value when the magnetic induction strength of the magnet is equal to 90% of the remanence.

Example 2

A sintered NdFeB blank magnet prepare by using a normal process that does not include an aging treatment, wherein the magnet composition (wt. %) is $(PrNd)_{30.5}Al_{0.25}Co_{1.0}Cu_{0.1}Ga_{0.1}Fe_{bal}B_{0.97}$, the magnet size is Φ7 mm×3.3 mm, and the orienting direction is parallel to the axial direction.

5 g of $DyF_3$ powder with the particle size of 5 μm is stirred in 20 ml of absolute ethanol to form the slurry.

The slurry is uniformly coated onto the surface of the magnet in a dip-coating manner, wherein the coating thickness on the two end surfaces of the sample is 0.15 mm.

The sample is placed in an open environment and normal-temperature dealcoholization is performed for 120 minutes.

A two-stage heat treatment is performed on the magnet coated with the slurry on its surface.

In the first-stage heat treatment, the magnet coated with the slurry on its surface is placed in a vacuum microwave processing furnace for microwave heating, wherein the transmitting power is 2450 MHz, the heating temperature is set as 900° C., the heat preservation lasts for 3 minutes, and microwave transmission stops after the heat preservation is completed. The sample is cooled in a furnace cooling manner till the temperature is below 100° C., and is then taken out.

Then, the second-stage heat treatment is performed, in which the sample after the first-stage heat treatment is placed in a normal vacuum heat-source heating furnace to perform the vacuum heat treatment at 490° C. for 160 minutes; after that, the sample is cooled to below 100° C. in a furnace cooling or air-cooling manner, and then the magnet is taken out.

The residual heavy rare earth source layer is removed from the surface of the magnet in a machining manner, and the magnetic properties of the magnet are measured.

Comparative Example 2-1

The only difference between Comparative Example 2-1 and Example 2 is that the first-stage heat treatment adopts normal heat-source heating, and the heat preservation lasts for 150 minutes.

Comparative Example 2-2

The difference between Comparative Example 2-2 and Comparative Example 2-1 is that no surface coating process is performed before the heat treatment of the magnet.

Comparative Example 2-3

The difference between Comparative Example 2-3 and Example 2 is that no surface coating process is performed before the heat treatment of the magnet.

TABLE 2

Magnetic properties of Example 2 and Comparative Example 2

| | $B_r$ (kGs) | $H_{cj}$ (kOe) | $(BH)_{max}$ (MGOe) | $H_k/H_{cj}$ |
|---|---|---|---|---|
| Example 2 | 13.75 | 17.80 | 46.63 | 0.934 |
| Comparative Example 2-1 | 13.58 | 18.32 | 45.41 | 0.950 |
| Comparative Example 2-2 | 13.72 | 15.23 | 46.18 | 0.977 |
| Comparative Example 2-3 | 13.72 | 15.37 | 46.24 | 0.973 |

Note:

$H_k$ is an external magnetic field value when the magnetic induction strength of the magnet is equal to 90% of the remanence.

Example 3

A sintered NdFeB blank magnet is prepared by using a normal process (not including an aging treatment), wherein the magnet composition (wt. %) is $(PrNd)_{30.5}Al_{0.25}Co_{1.0}Cu_{0.1}Ga_{0.1}Fe_{bal}B_{0.97}$, the magnet size is Φ7 mm×3.3 mm, and the orienting direction is parallel to the axial direction.

5 g of mixed powder including 50 wt % of terbium oxide, 30 wt % of an intermetallic compound (the composition thereof is 2% Ce-22% Nd-16% Dy-15% Tb-2% Ho-40.8% Fe-1% Co-0.1% Cu-0.5% Ni-0.2% Ga-0.2% Cr-0.2% Ti) in a $MgCu_2$-type structure, and 20 wt % of terbium nitrate hexahydrate is stirred in 20 ml of absolute ethanol to form the slurry.

The slurry is uniformly coated onto the surface of the magnet in a dip-coating manner, wherein the coating thickness on the upper and lower end surfaces of the magnet is preferably 0.2 mm. The sample is placed in a vacuum environment and normal-temperature dealcoholization is performed for 30 minutes.

A two-stage heat treatment is performed on the magnet coated with the slurry on its surface.

In the first-stage heat treatment, the magnet coated with the slurry on its surface is placed in a vacuum microwave processing furnace for microwave heating, wherein the microwave frequency is 2450 MHz, the heating temperature is set as 900° C., the heat preservation lasts for 3 minutes, and microwave transmission stops after the heat preservation is completed.

The sample is cooled in an air-cooling manner till the temperature of the sample is below 100° C., and is then taken out.

Then, the second-stage heat treatment is performed, in which the sample after the first-stage heat treatment is placed in a normal vacuum heat-source heating furnace to perform the vacuum heat treatment at 480° C. for 150 minutes; after that, the sample is cooled to below 100° C. in a furnace cooling or air-cooling manner, and then the magnet is taken out.

The residual heavy rare earth source layer is removed from the surface of the magnet in a machining manner, and the magnetic properties of the magnet are measured.

Comparative Example 3-1

The only difference between Comparative Example 3-1 and Example 3 is that the first-stage heat treatment adopts normal heat-source heating, and the heat preservation lasts for 120 minutes.

Comparative Example 3-2

The difference between Comparative Example 3-2 and Comparative Example 3-1 is that no surface coating process is performed before the heat treatment of the magnet.

Comparative Example 3-3

The difference between Comparative Example 3-3 and Example 3 is that no surface coating process is performed before the heat treatment of the magnet.

TABLE 3

Magnetic properties of Example 3 and Comparative Example 3

| | $B_r$ (kGs) | $H_{cj}$ (kOe) | $(BH)_{max}$ (MGOe) | $H_k/H_{cj}$ |
|---|---|---|---|---|
| Example 3 | 13.72 | 17.07 | 46.26 | 0.952 |
| Comparative Example 3-1 | 13.68 | 17.15 | 45.5 | 0.933 |

TABLE 3-continued

Magnetic properties of Example 3 and Comparative Example 3

| | $B_r$ (kGs) | $H_{cj}$ (kOe) | $(BH)_{max}$ (MGOe) | $H_k/H_{cj}$ |
|---|---|---|---|---|
| Comparative Example 3-2 | 13.72 | 15.23 | 46.18 | 0.977 |
| Comparative Example 3-3 | 13.72 | 15.37 | 46.24 | 0.973 |

Note:
$H_k$ is an external magnetic field value when the magnetic induction strength of the magnet is equal to 90% of the remanence.

Example 4

A sintered NdFeB blank magnet is prepared by using a normal process (not including an aging treatment), wherein the magnet composition (wt. %) is $(PrNd)_{30.5}Al_{0.25}Co_{1.0}Cu_{0.1}Ga_{0.1}Fe_{bal}B_{0.97}$, the magnet size is Φ7 mm×3.3 mm, and the orienting direction is parallel to the axial direction.

5 g of mixed powder with the average particle size of 15 μm, including 60 wt % of dysprosium oxide, 20 wt % of holmium nitrate pentahydrate and 20 wt % of DyHx, is stirred in 20 ml of absolute ethanol to form the slurry.

The slurry is uniformly coated onto the surface of the magnet in a dip-coating manner, wherein the coating thickness on the upper and lower end surfaces of the magnet is preferably 0.2 mm. The sample is placed in a vacuum environment and normal-temperature dealcoholization is performed for 30 minutes.

A two-stage heat treatment is performed on the magnet coated with the slurry on its surface.

In the first-stage heat treatment, the magnet coated with the slurry on its surface is placed in a vacuum microwave processing furnace for microwave heating, wherein the microwave frequency is 2450 MHz, the heating temperature is set as 920° C., the heat preservation lasts for 3 minutes, and microwave transmission stops after the heat preservation is completed.

The sample is cooled in an air-cooling manner till the temperature of the sample is below 100° C., and is taken out.

Then, the second-stage heat treatment is performed, in which the sample after the first-stage heat treatment is placed in a normal vacuum heat-source heating furnace to perform vacuum heat treatment at 500° C. for 150 minutes; after that, the sample is cooled to below 100° C. in a furnace cooling or air-cooling manner, and the magnet is taken out.

The residual heavy rare earth source layer is removed from the surface of the magnet in a machining manner, and the magnetic properties of the magnet are measured.

Comparative Example 4-1

The only difference between Comparative Example 4-1 and Example 4 is that the first-stage heat treatment adopts normal heat-source heating, and the heat preservation lasts for 115 minutes.

Comparative Example 4-2

The difference between Comparative Example 4-2 and Comparative Example 4-1 is that no surface coating process is performed before the heat treatment of the magnet.

Comparative Example 4-3

The difference between Comparative Example 4-3 and Example 4 is that no surface coating process is performed before the heat treatment of the magnet.

TABLE 4

Magnetic properties of Example 4 and Comparative Example 4

| | $B_r$ (kGs) | $H_{cj}$ (kOe) | $(BH)_{max}$ (MGOe) | $H_k/H_{cj}$ |
|---|---|---|---|---|
| Example 4 | 13.73 | 15.93 | 46.25 | 0.955 |
| Comparative Example 4-1 | 13.70 | 16.72 | 45.8 | 0.938 |
| Comparative Example 4-2 | 13.72 | 15.23 | 46.18 | 0.977 |
| Comparative Example 4-3 | 13.72 | 15.37 | 46.24 | 0.973 |

Note:
$H_k$ is an external magnetic field value when the magnetic induction strength of the magnet is equal to 90% of the remanence.

Example 5

A sintered NdFeB blank magnet is prepared by using a normal process (not including an aging treatment), wherein the magnet composition (wt. %) is $(PrNd)_{30.5}Al_{0.25}Co_{1.0}Cu_{0.1}Ga_{0.1}Fe_{bal}B_{0.97}$, the magnet size is Φ7 mm×3.3 mm, and the orienting direction is parallel to the axial direction.

5 g of mixed powder with the average particle size of 5 μm, including 60 wt % of DyFe and 40 wt % of PrNdHx, is stirred in 20 ml of absolute ethanol to form the slurry.

The slurry is uniformly coated onto the surface of the magnet in a dip-coating manner, wherein the coating thickness on the upper and lower end surfaces of the magnet is preferably 0.2 mm. The sample is placed in a vacuum environment and normal-temperature dealcoholization is performed for 30 minutes.

A two-stage heat treatment is performed on the magnet coated with the slurry on its surface.

In the first-stage heat treatment, the magnet coated with the slurry on its surface is placed in a vacuum microwave processing furnace for microwave heating, wherein the microwave frequency is 2450 MHz, the heating temperature is set as 910° C., the heat preservation lasts for 3 minutes, and microwave transmission stops after the heat preservation is completed.

The sample is cooled in an air-cooling manner till the temperature of the sample is below 100° C., and is then taken out.

Then, the second-stage heat treatment is performed, in which the sample after the first-stage heat treatment is placed in a normal vacuum heat-source heating furnace to perform the vacuum heat treatment at 480° C. for 150 minutes; after that, the sample is cooled to below 100° C. in a furnace cooling or air-cooling manner, and the magnet is taken out.

The residual heavy rare earth source layer is removed from the surface of the magnet in a machining manner, and the magnetic properties of the magnet are measured.

Comparative Example 5-1

The only difference between Comparative Example 5-1 and Example 5 is that the first-stage heat treatment adopts normal heat-source heating, and the heat preservation lasts for 150 minutes.

Comparative Example 5-2

The difference between Comparative Example 5-2 and Comparative Example 5-1 is that no surface coating process is performed before the heat treatment of the magnet.

Comparative Example 5-3

The difference between Comparative Example 5-3 and Example 5 is that no surface coating process is performed before the heat treatment of the magnet.

TABLE 5

Magnetic properties of Example 5 and Comparative Example 5

| | $B_r$ (kGs) | $H_{cj}$ (kOe) | $(BH)_{max}$ (MGOe) | $H_k/H_{cj}$ |
|---|---|---|---|---|
| Example 5 | 13.70 | 15.63 | 45.60 | 0.951 |
| Comparative Example 5-1 | 13.70 | 16.17 | 45.8 | 0.947 |
| Comparative Example 5-2 | 13.72 | 15.23 | 46.18 | 0.977 |
| Comparative Example 5-3 | 13.72 | 15.37 | 46.24 | 0.973 |

Note:
$H_k$ is an external magnetic field value when the magnetic induction strength of the magnet is equal to 90% of the remanence.

In the present invention, by combining the microwave heat treatment and grain boundary heat diffusion and by improving grain boundary features as well as the interaction between the grain boundary and the main phase grains, the magnetocrystalline anisotropy field on the surface layer of each main phase grain is improved, and then the intrinsic coercive force Hcj of the sintered NdFeB magnet is improved, and meanwhile, the influence on the remanence Br and the maximum magnetic energy product (BH)max is small.

Figure 2:
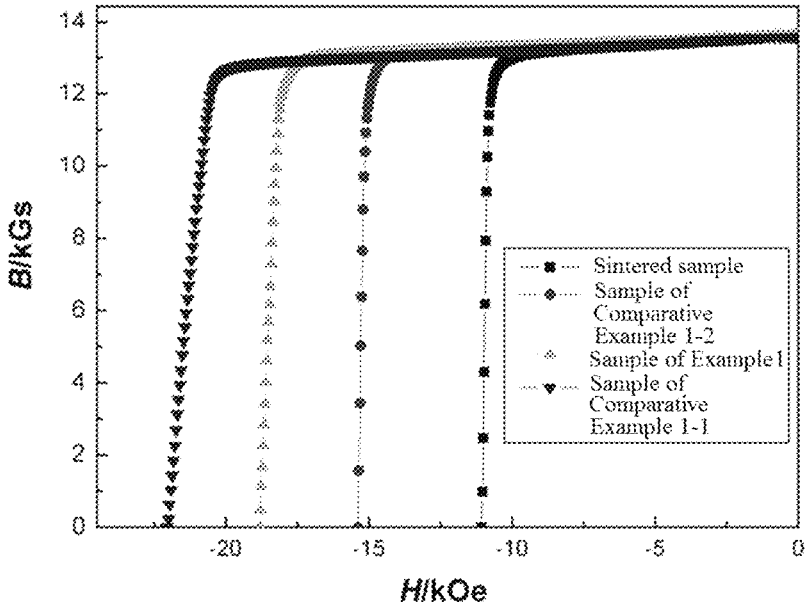
FIG. 2 shows demagnetizing curves of magnets in Example 1 and Comparative Examples 1-1, 1-2, 1-3.

The demagnetizing curves in FIG. 2 indicate a comparison between the magnetic properties of samples after microwave diffusion and the heat treatment in Table 1 and the properties of a sintered sample, and it can be seen from the results in FIG. 2 that the magnetic properties of the products after microwave treatment are improved. The "sintered sample" in FIG. 2 refers to the magnet prepared after Step 1.

Figure 3:
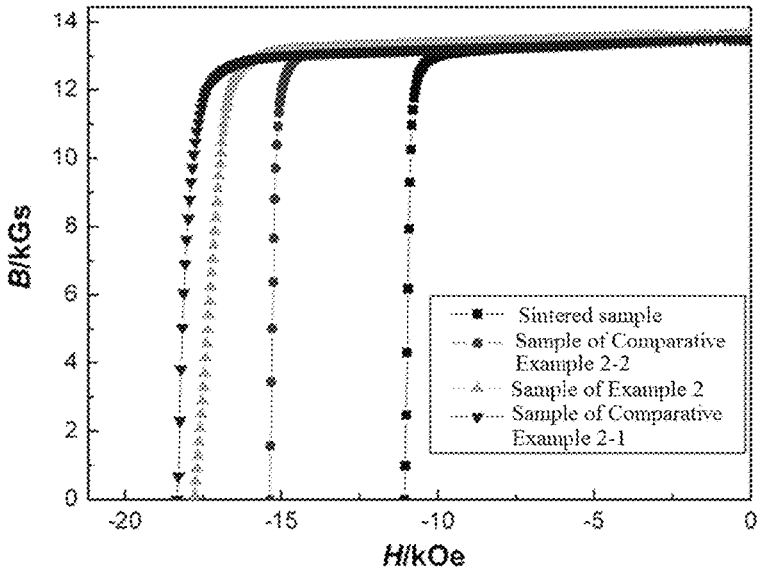
FIG. 3 shows demagnetizing curves of magnets in Example 2 and Comparative Examples 2-1, 2-2, 2-3.

The demagnetizing curves in FIG. 3 indicate comparison between the magnetic properties of samples after microwave diffusion and heat treatment in Table 2 and the properties of a sintered sample, and it can be seen from the results in FIG. 3 that the magnetic properties of the products after microwave treatment are improved. The "sintered sample" in FIG. 3 refers to the magnet prepared after Step 1.

Table 1 lists the magnetic properties of the magnets in Example 1, Comparative Example 1-1, Comparative Example 1-2, and Comparative Example 1-3.

Example 1 adopts the method of the present invention, wherein Tb—Cu is used as the heavy rare earth raw material, and the microwave heating technology is adopted to perform grain boundary heat diffusion of the heavy rare earth elements.

Comparative Example 1-1 adopts a normal heating method to perform diffusion of the same material.

Comparative Example 1-2 and Comparative Example 1-3 are control samples obtained by performing synchronous heat treatments on original sintered samples without surface coating, wherein Comparative Example 1-2 and Comparative Example 1-1 have the same heat treatment process, and Comparative Example 1-3 and Example 1 have the same heat treatment process.

It can be seen from data shown in Table 1 that, sintered samples without coating have basically the same magnetic properties whether they are processed by the microwave treatment (Comparative Example 1-3) or the normal heat treatment (Comparative Example 1-2). While for the sintered sample coated with a heavy rare earth source on its surface, the coercive force thereof after the microwave heat treatment is 3.5 kOe higher than that of a sample without coating, and the remanence basically stays the same. Although the increase of the coercive force is less than that of Comparative Example 1-1, the heat preservation time is merely 3 minutes which is much less than that of Comparative Example 1-1, and thus the method has the significant industrial application value.

Figure 4A:
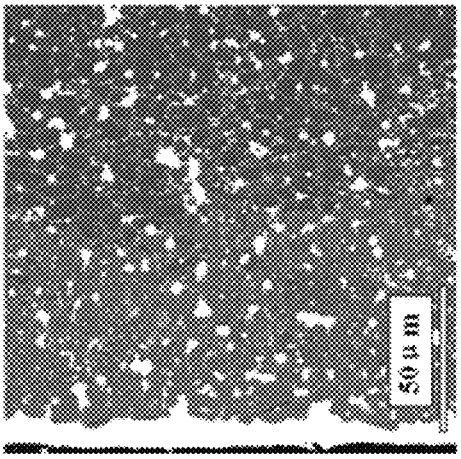
FIG. 4*a* is a back scattering image at the edge of a polished section of the magnet in Example 1.
Figure 4B:
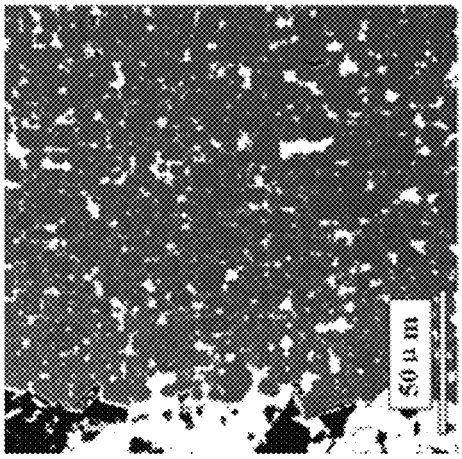
FIG. 4*b* is a back scattering image at the edge of a polished section of the magnet in Comparative Example 1-1.
Figure 6A:
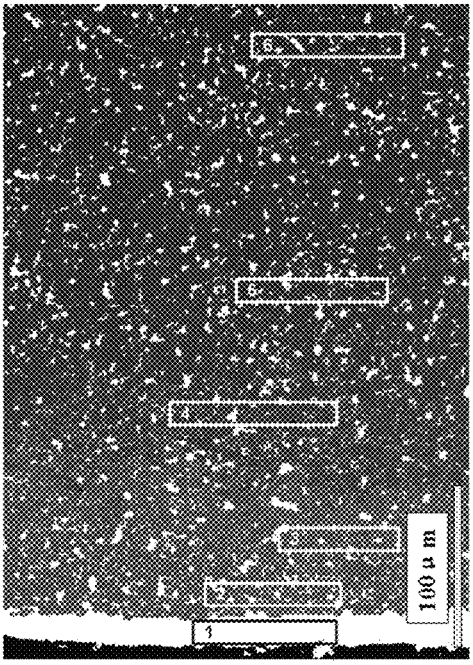
FIG. 6*a* is an energy spectrum analysis diagram at the edge of the polished section of the magnet in Example 1.
Figure 6B:
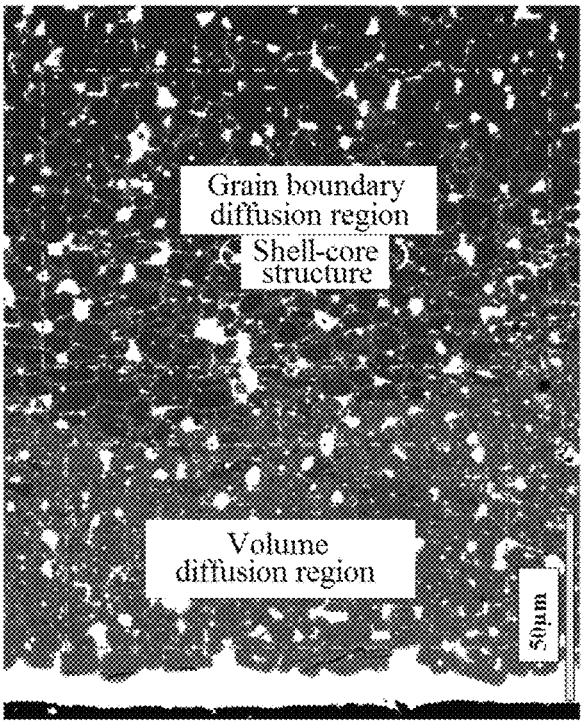
FIG. 6*b* is an electron-microscopic image of regional features at the edge of the polished section of the magnet in Example 1.

It can be seen from the microscopic structure image of FIG. 4*a* that, the permeating effect of the Tb element at the edge of the sample in Example 1 is obvious, and the diffusion amount is much greater than that of the sample in Comparative Example 1-1 (FIG. 4*b*). The region 1 in FIG. 6*a* is a residual coating layer on the surface of the sample in Example 1 after microwave diffusion. Because the service power of the microwave source is higher, a volume diffusion region exists on the edge of the sample in Example 1 and is in the orienting depth direction of the magnet, and the thickness thereof is about 70 μm. It can be seen from the energy spectrum analysis results of the regions 2 and 3 in FIG. 6*a* that, the contents of Tb in these regions are respectively 8 at % and 7.5 at %, wherein the difference is 0.5 at %, which shows that the concentration difference of the heavy rare earth elements diffused in the volume diffusion region is small. When the detection depth reaches 100 to 200 μm (the regions 4 and 5 in FIG. 6*a*), the contents of Tb are respectively 2.19 at % and 0.45 at %. Above 70% of the grains in the regions 4 and 5 show an obvious shell-core structure. When the detection depth exceeds 350 μm, as shown in the region 6 in FIG. 6*a*, an obvious content of Tb is hard to detect. FIG. 6*b* shows the ranges of the volume diffusion region and the grain boundary diffusion region of the sample in Example 1.

Figure 7:
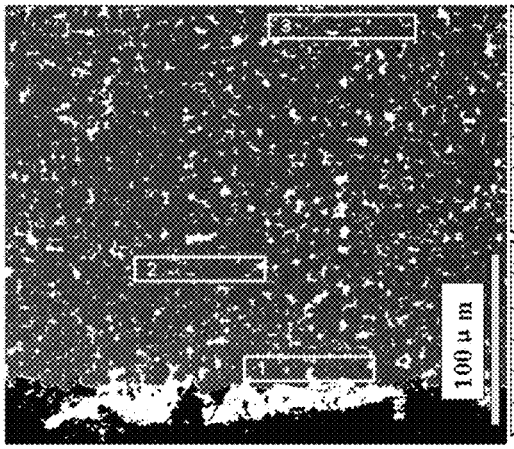
FIG. 7 is an energy spectrum analysis diagram at the edge of the polished section of the magnet in Comparative Example 1-1.

The volume diffusion depth in Comparative Example 1-1 is about 25 μm which is smaller than that in Example 1, and when the detection depth exceeds 200 μm, an obvious content of Tb is hard to detect (FIG. 7). It indicates that, due to the activation effect of the microwave heat treatment, the effect of diffusion reaction is more obvious in the condition of the same maximum heat treatment temperature. No obvious volume diffusion region is seen in FIG. 7.

By changing the microwave transmitting power and frequency, the heat treatment temperature, and the heat preservation time, the microscopic structure in the magnet and the magnetic properties after diffusion can be adjusted.

Table 2 lists the magnetic properties of the magnets in Example 2, Comparative Example 2-1, Comparative Example 2-2, and Comparative Example 2-3.

Example 2 adopts the method of the present invention, wherein Dy—F is used as the heavy rare earth source material, and the microwave heating technology is adopted to perform grain boundary heat diffusion of the heavy rare earth elements.

Comparative Example 2-1 adopts a normal heating method to perform diffusion of the same material.

Comparative Example 2-2 and Comparative Example 2-3 are control samples obtained by performing synchronous heat treatment on original sintered samples without surface coating, wherein Comparative Example 2-2 and Comparative Example 2-1 have the same heat treatment process, and Comparative Example 2-3 and Example 2 have the same heat treatment process.

It can be seen from data shown in Table 2 that, a sintered sample without coating has basically the same magnetic properties whether they are processed by the microwave treatment (Comparative Example 2-3) or the normal heat treatment (Comparative Example 2-2).

While for a sintered sample coated with a heavy rare earth source on its surface, the coercive force thereof after the microwave heat treatment is 2.5 kOe higher than that of the sample without coating, and the remanence basically stays the same. Although the increase of the coercive force is less than that of Comparative Example 2-1, the heat preservation time is merely 3 minutes which is much less than that of Comparative Example 1, and thus the method has the significant industrial application value.

Figure 5A:
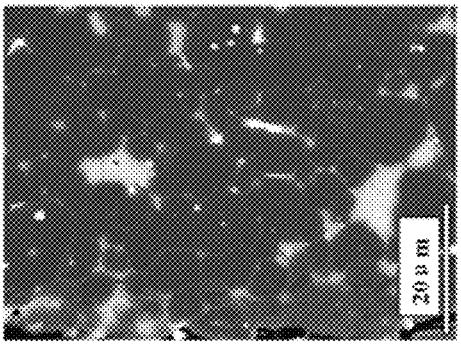
FIG. 5*a* is a back scattering image at the edge of a polished section of the magnet in Example 2.
Figure 5B:
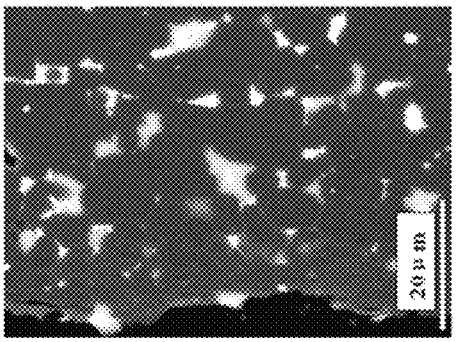
FIG. 5*b* is a back scattering image at the edge of a polished section of the magnet in Comparative Example 2-1.

It can be seen from the microscopic structure image of FIG. 5*a* that, the permeating effect of the Dy element at the edge of the sample in Example 2 is obvious, and is equivalent to that of the sample in Comparative Example 2-1 (FIG. 5*b*). Therefore, the properties of the sample can be optimized by adjusting the microwave heating temperature and the heating time.

The above embodiments are merely exemplary embodiments of the present invention and are not intended to limit the protection scope of the invention, which is defined by the claims. Various modifications or equivalent substitutions may be made to the present invention by a person skilled in the art within the spirit and protection scope of the present invention, and such modifications or equivalent substitutions are also deemed to fall within the protection scope of the present invention.

The invention claimed is:

1. A rare earth permanent magnet, comprising a heavy rare earth element volume diffusion layer region from a surface of the magnet to an interior of the magnet along the magnetic field orientation direction, a depth of from the surface of the magnet to the interior of the magnet along a magnetic field orientation direction is 5 μm to 100 μm, the volume diffusion layer region comprises a plurality of magnet units having a volume of 10*100*5 μm, and the concentration difference of the heavy rare earth elements of the magnet units at different positions in the volume diffusion layer is below 0.5 at %.

2. The rare earth permanent magnet according to claim 1, wherein the heavy rare earth elements are Tb and Dy.

3. The rare earth permanent magnet according to claim 2, wherein a grain boundary diffusion region comprising grains exists between the volume diffusion layer region of the magnet and the internal magnet.

4. The rare earth permanent magnet according to claim 3, the difference between the heavy rare earth content in the internal magnet and the heavy rare earth content in the magnet before diffusion is not greater than 0.1 at %.

* * * * *